US008616151B2

(12) United States Patent
Hoshino

(10) Patent No.: US 8,616,151 B2
(45) Date of Patent: Dec. 31, 2013

(54) ADHESIVE APPLICATION APPARATUS AND CONTROL METHOD OF THE SAME

(75) Inventor: Masaru Hoshino, Fujimi-machi (JP)

(73) Assignee: Seiko Epson Corporation, Tokyo (JP)

( * ) Notice: Subject to any disclaimer, the term of this patent is extended or adjusted under 35 U.S.C. 154(b) by 37 days.

(21) Appl. No.: 13/370,187

(22) Filed: Feb. 9, 2012

(65) Prior Publication Data

US 2012/0207924 A1 Aug. 16, 2012

(30) Foreign Application Priority Data

Feb. 15, 2011 (JP) ..... 2011-029498

(51) Int. Cl.
*B05D 5/10* (2006.01)
*B05D 7/12* (2006.01)
*B29C 65/00* (2006.01)

(52) U.S. Cl.
USPC ..... 118/663; 118/314; 118/696; 427/207.1; 427/208; 156/291; 156/295

(58) Field of Classification Search
USPC ..... 118/314, 663; 347/15, 43; 156/256, 156/291, 295; 427/207.1, 208; 700/90
See application file for complete search history.

(56) References Cited

U.S. PATENT DOCUMENTS 6,561,610 B2 * 5/2003 Yamasaki et al. ..... 347/15
2011/0151115 A1 * 6/2011 Lingier ..... 118/314

FOREIGN PATENT DOCUMENTS

JP 2009-279538 12/2009

* cited by examiner

*Primary Examiner* — Dah-Wei Yuan
*Assistant Examiner* — Binu Thomas
(74) *Attorney, Agent, or Firm* — Workman Nydegger

(57) ABSTRACT

A paste formation pattern for odd numbers on which dot groups are arranged in an island form and a paste formation pattern for even numbers on which dot groups are arranged at opposing positions to the dot groups on the paste formation pattern for odd numbers in an island form are set. Further, a paste discharge head is controlled such that the set paste formation pattern for odd numbers is formed on an adhesion surface of an odd-numbered sheet of paper and the discharge head is controlled such that the set paste formation pattern for even numbers is formed on an adhesion surface of an even-numbered sheet of paper.

3 Claims, 7 Drawing Sheets

WHEN DEVIATION IS NOT GENERATED

WHEN DEVIATION IS GENERATED

ADHESIVE APPLICATION APPARATUS AND CONTROL METHOD OF THE SAME

This application claims the benefit of Japanese Application No. 2011-029498, filed Feb. 15, 2011, all of which are hereby incorporated by reference.

BACKGROUND

1. Technical Field

The present invention relates to an adhesive application apparatus which discharges an adhesive from a discharge head onto adhesion surfaces of media, which are pasted to each other, so as to apply the adhesive thereto in dot-pattern form and a control method of the same.

2. Related Art

As an adhesive application apparatus of this type, an adhesive application apparatus which discharges liquid droplets containing an adhesive with an ink jet system so as to apply the adhesive to an adhesion surface of a medium has been proposed (for example, see JP-A-2009-279538). In the apparatus, an adhesive application amount per unit area on a contour portion is made smaller than that on a center portion of the adhesion surface in order to suppress the adhesive from running off from the contour portion when the adhesion surface is adhered.

As described above, it is considered that what the adhesive application amount is made smaller while ensuring an adhesive force is an important object in the adhesive application apparatus. Note that a case where the adhesive is applied to both surfaces of media so as to paste them to each other is considered. In this case, the adhesive application amount tends to be larger in comparison with a case where the adhesive is applied to an adhesion surface of one medium only and the medium is pasted to a target medium. Therefore, the above object is considered to be more important in that case.

SUMMARY

An advantage of some aspects of the invention is to provide an adhesive application apparatus and a control method of the same, which suppress an adhesive application amount while ensuring an appropriate adhesive force when adhesion surfaces of media are pasted to each other.

The adhesive application apparatus and the control method of the same according to some aspects of the invention employ the following means for realizing the above-described advantage.

An adhesive application apparatus according to an aspect of the invention which discharges an adhesive from a discharge head onto adhesion surfaces of media, which are pasted to each other, so as to apply the adhesive in dot-pattern form, includes a dot pattern setting unit that sets a first dot pattern on which dot groups each of which is formed by a plurality of dots are arranged in an island form and a second dot pattern on which dot groups each of which is formed by a plurality of dots are arranged at opposing positions to the dot groups on the first dot pattern in an island form, and a control unit that controls the discharge head such that the set first dot pattern is formed on one adhesion surface of the adhesion surfaces and controls the discharge head such that the set second dot pattern is formed on the other adhesion surface of the adhesion surfaces.

In the adhesive application apparatus according to the aspect of the invention, the first dot pattern on which dot groups each of which is formed by a plurality of dots are arranged in an island form and the second dot pattern on which dot groups each of which is formed by a plurality of dots are arranged at opposing positions to the dot groups on the first dot pattern in an island form are set. Further, the discharge head is controlled such that the set first dot pattern is formed on one adhesion surface of the adhesion surfaces and the discharge head is controlled such that the set second dot pattern is formed on the other adhesion surface of the adhesion surfaces. With this, application regions to which adhesive is applied are formed on both the adhesion surfaces in an island form. Therefore, an adhesive application amount can be suppressed in comparison with a case where the adhesive is uniformly applied to the entire of both the adhesion surfaces. The opposing positions indicate positions at which centers of the respective dot groups are identical to each other when the adhesion surface on which dot groups of the first dot pattern are formed and the adhesion surface on which dot groups of the second dot pattern are formed are pasted to each other. Therefore, if the dot groups on the first dot pattern and the dot groups on the second dot pattern are arranged at the opposing positions, the application regions formed on one adhesion surface in an island form and the application regions formed on the other adhesion surface in an island form can be overlapped with one another. Accordingly, a sufficient adhesive force can be obtained even if the adhesive application amount is suppressed. As a result, the adhesive application amount can be also suppressed while ensuring an appropriate adhesive force when the adhesion surfaces of media are pasted to each other.

Further, in the adhesive application apparatus according to the aspect of the invention, it is preferable that the dot pattern setting unit form each dot group on the second dot pattern so as to be one size smaller than each dot group on the first dot pattern. With this, the adhesive application amount can be further suppressed while overlapping the application regions formed on one adhesion surface in an island form and the application regions formed on the other adhesion surface in an island form with one another. Further, in the adhesive application apparatus according to the aspect of the invention, it is preferable that the dot pattern setting unit arrange each dot group in which dots positioned at an outer-most circumference among dots forming each dot group on the first dot pattern are not formed as each dot group on the second dot pattern.

Further, in the adhesive application apparatus according to the aspect of the invention, it is preferable that the dot pattern setting unit set the second dot pattern such that each dot group on the second dot pattern is arranged at an opposing position to each dot group on the first dot pattern under a condition that a predetermined type of media is used as the media. With this, the application regions formed on one adhesion surface and the application regions formed on the other adhesion surface can be overlapped with one another only when a predetermined type of media is used. In the adhesive application apparatus according to the aspect of the invention, it is preferable that the dot pattern setting unit set the second dot pattern such that each dot group on the second dot pattern is arranged at a non-opposing position deviated from the opposing position to each dot group on the first dot pattern when media of which type is different from the predetermined type are used as the media. This makes it possible to appropriately cope with media of which type is different from the predetermined type.

A control method of an adhesive application apparatus which discharges an adhesive from a discharge head onto adhesion surfaces of media, which are pasted to each other, so as to apply the adhesive in a dot-pattern form according to another aspect of the invention, includes; setting a first dot pattern on which dot groups each of which is formed by a plurality of dots are arranged in an island form and a second dot pattern on which dot groups each of which is formed by a plurality of dots are arranged at opposing positions to the dot groups on the first dot pattern in an island form; and controlling the discharge head such that the set first dot pattern is formed on one adhesion surface of the adhesion surfaces and controlling the discharge head such that the set second dot pattern is formed on the other adhesion surface of the adhesion surfaces.

In the control method of the adhesive application apparatus according to the aspect of the invention, the first dot pattern on which dot groups each of which is formed by a plurality of dots are arranged in an island form and the second dot pattern on which dot groups each of which is formed by a plurality of dots are arranged at opposing positions to the dot groups on the first dot pattern in an island form are set. Further, the discharge head is controlled such that the set first dot pattern is formed on one adhesion surface of the adhesion surfaces and the discharge head is controlled such that the set second dot pattern is formed on the other adhesion surface of the adhesion surfaces. With this, application regions to which adhesive is applied are formed on both the adhesion surfaces in an island form. Therefore, an adhesive application amount can be suppressed in comparison with a case where the adhesive is uniformly applied to the entire of both the adhesion surfaces. Further, if the dot groups on the first dot pattern and the dot groups on the second dot pattern are arranged at the opposing positions, the application regions formed on one adhesion surface in an island form and the application regions formed on the other adhesion surface in an island form can be overlapped with one another. Accordingly, a sufficient adhesive force can be obtained even if the adhesive application amount is suppressed. As a result, the adhesive application amount can be also suppressed while ensuring an appropriate adhesive force when the adhesion surfaces of media are pasted to each other. Note that, in the control method of the adhesive application apparatus, various aspects of the adhesive application apparatuses described above may be employed, or a step that implements each of the functions of the adhesive application apparatuses described above may be added.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
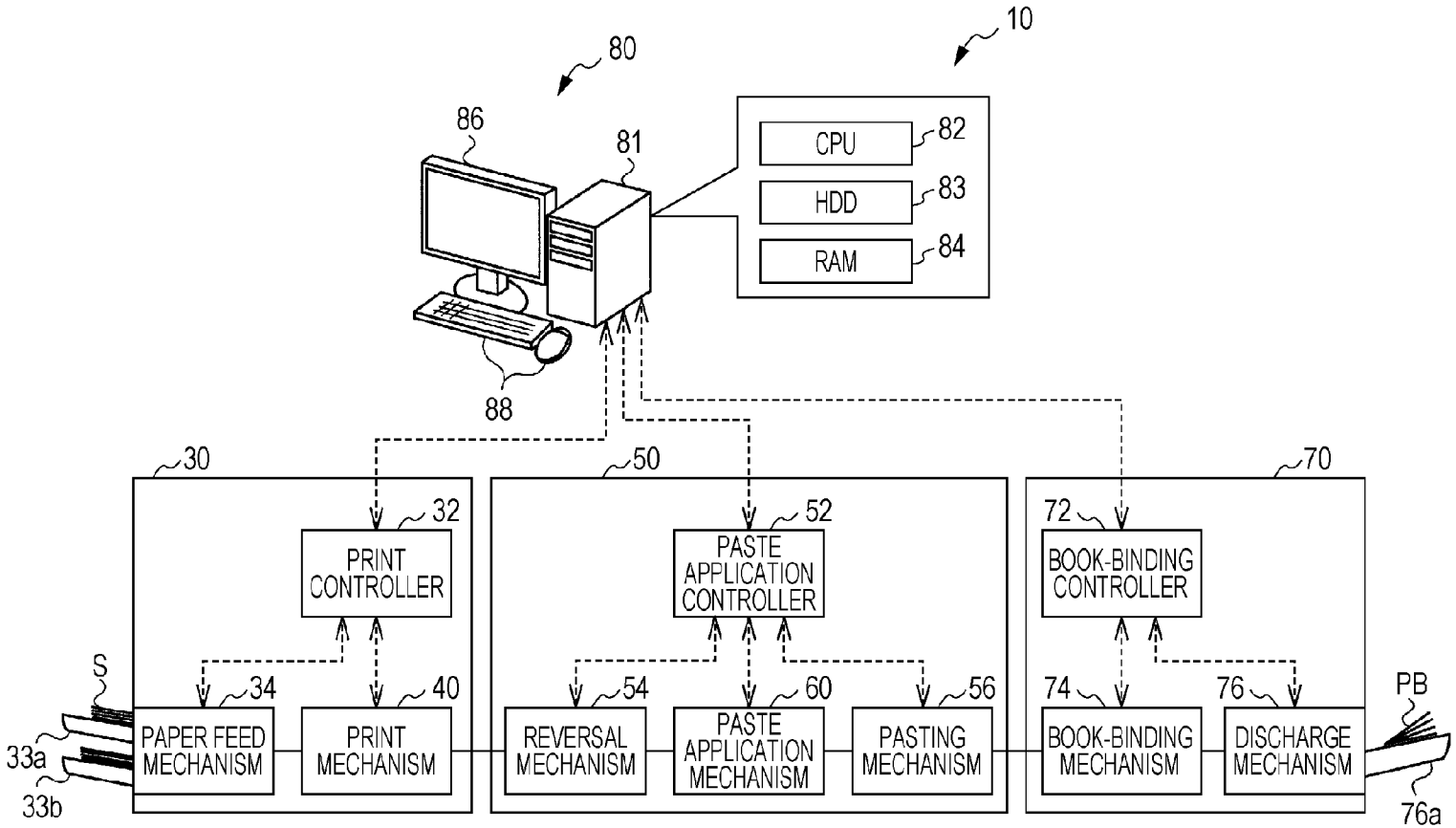
FIG. 1 is a block diagram illustrating an example of a schematic configuration of a book-binding system.
Figure 2:
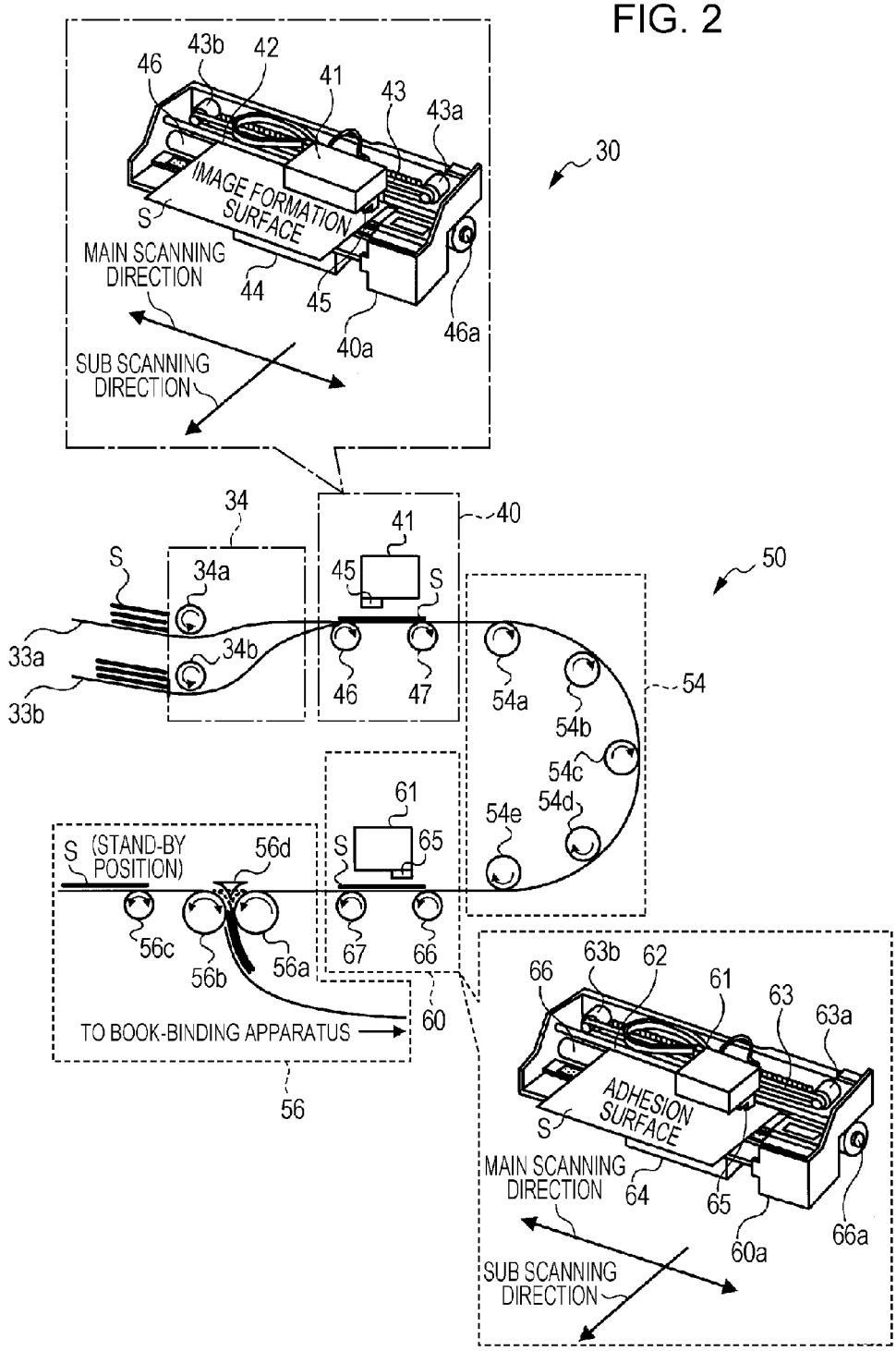
FIG. 2 is a block diagram illustrating an example of a schematic configuration of a print apparatus and a paste application apparatus.
Figure 3:
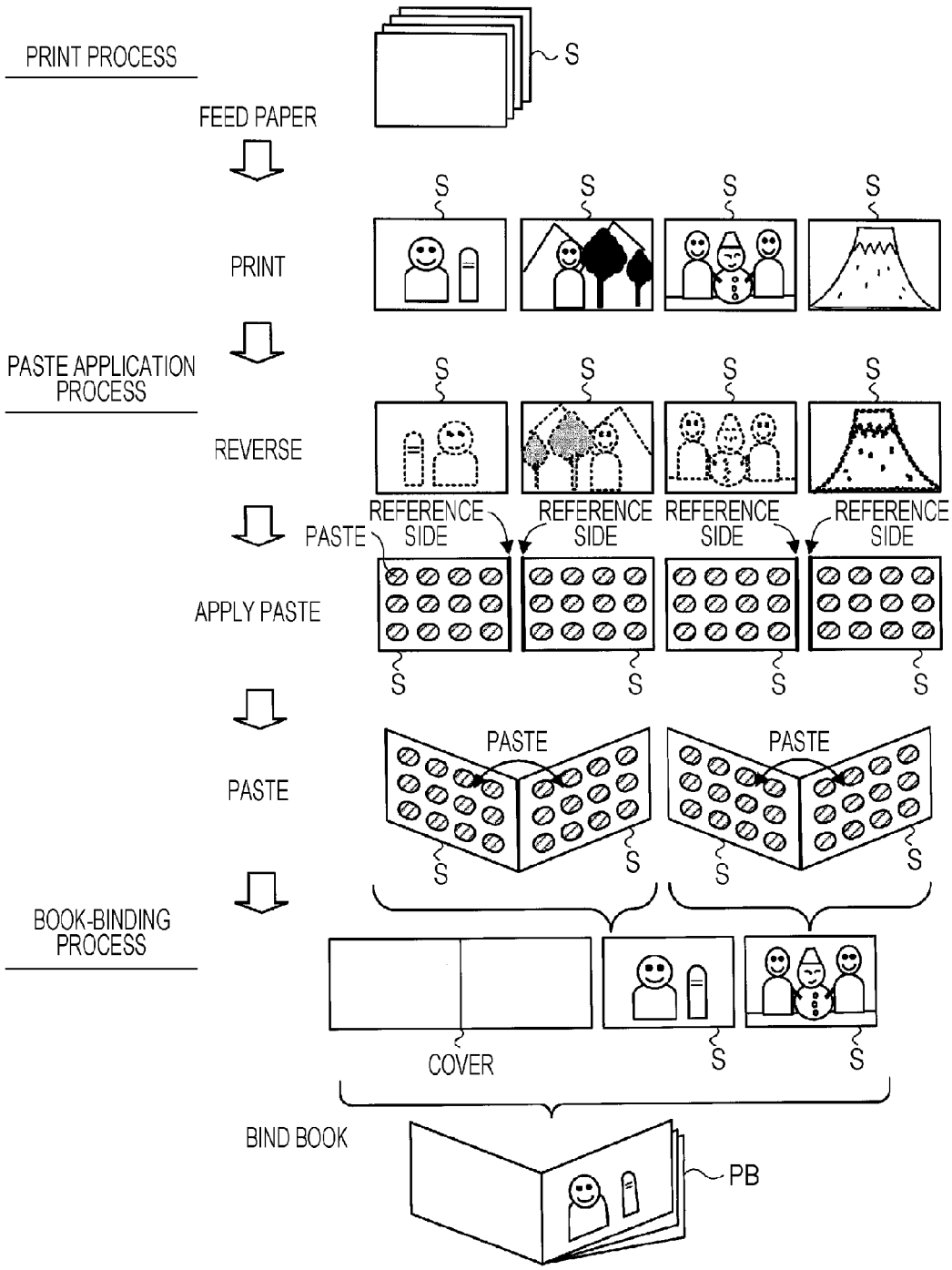
FIG. 3 is a descriptive diagram illustrating an example of each process in the book-binding system.

Next, an embodiment of the invention is described with reference to drawings. FIG. 1 is a block diagram illustrating an example of a schematic configuration of a book-binding system 10 including a paste application apparatus 50 as an embodiment of the invention. FIG. 2 is a block diagram illustrating schematic configurations of a print apparatus 30 and the paste application apparatus 50 in the book-binding system 10. FIG. 3 is a descriptive diagram illustrating an example of each process in the book-binding system 10. As illustrated in FIGS. 1 and 2, the book-binding system 10 in the embodiment includes the print apparatus 30, the paste application apparatus 50, a book-binding apparatus 70, and a computer 80. The print apparatus 30 performs a print process (see, FIG. 3 for each process) in which an image such as a picture is printed on a front surface (image formation surface) of a fed paper S. The paste application apparatus 50 performs a paste application process in which the printed paper S is reversed and paste is applied to a rear surface (paste application surface) thereof so as to paste adhesion surfaces to each other. The book-binding apparatus 70 performs a book-binding process in which the papers S of which adhesion surfaces have been pasted to each other are combined with a book cover to bind into a photo book PB. The computer 80 controls the entire system. In the embodiment, an adhesion surface of an odd-numbered sheet of paper S and an adhesion surface of an even-numbered sheet of paper S are pasted to each other. Further, in FIG. 2, each configuration of the print apparatus 30 is surrounded by a dashed-dotted line and each configuration of the paste application apparatus 50 is surrounded by a dotted line.

As illustrated in FIG. 1, the print apparatus 30 includes a print controller 32, a paper feed mechanism 34, and a print mechanism 40. The print controller 32 has a CPU, a ROM, a RAM (not illustrated), and the like and controls the entire apparatus. The paper feed mechanism 34 has two paper feed trays 33*a*, 33*b*, paper feed rollers 34*a*, 34*b* (see, FIG. 2), and the like and feeds the paper S. Two types of papers S can be set on the paper feed trays 33*a*, 33*b* and the paper feed rollers 34*a*, 34*b* are provided on the paper feed trays 33*a*, 33*b*, respectively. The print mechanism 40 discharges ink onto the paper S fed by the paper feed mechanism 34 with an ink jet system. It is to be noted that the two types of papers S are different from each other in a permeation degree of ink or paste, paper thickness, paper size, and the like.

The print controller 32 is connected to the computer 80 in a communicable manner, receives a print command from the computer 80, and transmits a print state to the computer 80. The print controller 32 controls the paper feed mechanism 34 to feed the paper S from a tray on which a specified type of paper S is set in the paper feed trays 33*a*, 33*b* based on specification of the type of paper S, which is contained in the received print command. Further, the print controller 32 controls the print mechanism 40 to execute a print processing on the paper S based on print data contained in the print command.

As illustrated in FIG. 2, the print mechanism 40 includes a carriage motor 43*a*, a slave roller 43*b*, a carriage belt 43, a carriage 41, ink cartridges 44, a print head 45, a transport roller 46, a drive motor 46*a* and a discharge roller 47. The carriage motor 43*a* is arranged at a right side of a mechanical frame 40*a* in FIG. 2. The slave roller 43*b* is arranged at a left side of the mechanical frame 40*a* in FIG. 2. The carriage belt 43 is wound around the carriage motor 43*a* and the slave roller 43*b* in a loop form in a right-left direction (main scanning direction). The carriage 41 is driven by the carriage belt 43 by driving the carriage motor 43*a* and reciprocates laterally along a guide 42. The ink cartridges 44 supply inks of colors of cyan (C), magenta (M), yellow (Y), and black (K) to the carriage 41 through tubes (not illustrated). The print head 45 applies a pressure to each ink supplied from each ink cartridge 44 to discharge the ink onto the paper S through a plurality of nozzles (not illustrated). The transport roller 46 transports the paper S in a sub scanning direction perpendicular to the main scanning direction. The drive motor 46*a* drives the transport roller 46. The discharge roller 47 is driven by a motor (not illustrated) to discharge the printed paper S to the side of the paste application apparatus 50. A plurality of nozzles (not illustrated) are formed on the print head 45 such that a density formed by ink to be discharged is 720 dpi, 1440 dpi, or the like. Further, the print head 45 employs a system in which a voltage is applied to piezoelectric elements so as to deform the piezoelectric elements and pressurize ink so that ink is discharged through each nozzle. However, the print head 45 may employ a system in which a voltage is applied to a heat generation resistor (for example, heater or the like) to heat ink and pressurize the ink with generated air bubbles.

As illustrated in FIG. 1, the paste application apparatus 50 includes a paste application controller 52, a reversal mechanism 54, a paste application mechanism 60, and a pasting mechanism 56. The paste application controller 52 has a CPU, a ROM, a RAM (not illustrated), and the like and controls the entire apparatus. The reversal mechanism 54 has a plurality of reversal rollers 54*a* to 54*e* (see, FIG. 2), a guide roller (not illustrated), and the like and reverses the paper S which has been printed by the print apparatus 30 upside down. The paste application mechanism 60 discharges and applies liquid-form paste onto the paper S which has been reversed by the reversal mechanism 54 with a system similar to the ink jet system. The pasting mechanism 56 pastes adhesion surfaces of the papers S to which the paste has been applied by the paste application mechanism 60 to each other.

The paste application controller 52 is connected to the computer 80 in a communicable manner, receives a paste application command from the computer 80, and transmits a paste application state to the computer 80. It is to be noted that the paste application command also contains specification of a type of paper S as in the print command. If the paste application controller 52 receives the paste application command, the paste application controller 52 controls the reversal mechanism 54 to reverse the printed paper S upside down and supply the paper S to the paste application mechanism 60 one by one, controls the paste application mechanism 60 to apply paste to the adhesion surface of the reversed paper S, and controls the pasting mechanism 56 to paste the adhesion surfaces of the papers S to which the paste has been applied to each other.

The paste application mechanism 60 is configured in the same manner as the print mechanism 40 except a point that the paste application mechanism 60 includes a liquid-form paste cartridge 64 and a paste discharge head 65 instead of the ink cartridges 44 and the print head 45 of the print mechanism 40. Therefore, each constituent component of the paste application mechanism 60 is designated with a reference numeral obtained by adding a value of 20 to the reference numeral of each constituent component of the print mechanism 40 and description thereof is omitted. It is to be noted that a plurality of nozzles (not illustrated) are formed on the paste discharge head 65 such that a dot density formed by paste to be discharged is 20 dpi, 60 dpi, 90 dpi or the like. Further, the paste discharge head 65 employs a system in which a voltage is applied to piezoelectric elements so as to deform the piezoelectric elements and pressurize paste so that the paste is discharged through each nozzle in the same manner as the print head 45.

The pasting mechanism 56 includes a pair of pasting rollers 56*a*, 56*b*, a transport roller 56*c*, and a guide 56*d*. The pair of pasting rollers 56*a*, 56*b* transport the paper S to which the paste has been applied by the paste application mechanism 60 and which has been discharged by the discharge roller 67, and paste the adhesion surfaces of the papers S to each other in a state where the papers S are pressed by a pressing mechanism (not illustrated). The transport roller 56*c* transports the paper S to a predetermined stand-by position. The guide 56*d* goes up and down between the pasting rollers 56*a*, 56*b* to guide the paper S. In the pasting mechanism 60, if the paste has been completely applied to the odd-numbered sheet of paper S, the pasting rollers 56*a*, 56*b* and the transport roller 56*c* are rotated forward in a left direction in FIG. 2 in a state where the guide 56*d* is made to go down (indicated by a dotted line in FIG. 2). With this, the paper S is transported to the predetermined stand-by position through an upper surface of the guide 56*d* so that the odd-numbered sheet of paper S is made into a stand-by state at the stand-by position. Then, if the paste has been completely applied to the subsequent even-numbered sheet of paper S, the transport roller 56*c* is rotated backward in a right direction in FIG. 2 and the odd-numbered sheet of paper S is transported from the stand-by position in a state where the guide 56*d* is made to go up (indicated by a solid line in FIG. 2). Then, a gripper (not illustrated) of the pasting roller 56*b* is made to grip an end of the odd-numbered sheet of paper S (end at the right side in FIG. 2, reference side in FIG. 3) and a gripper (not illustrated) of the pasting roller 56*a* is made to grip an end of the even-numbered sheet of paper S (end at the left side in FIG. 2, reference side in FIG. 3). Thereafter, the pasting roller 56*a* is rotated forward and the pasting roller 56*b* is rotated backward in a state where the pair of pasting rollers 56*a*, 56*b* are pressed against each other with the pressing mechanism (not illustrated). With this, the adhesion surfaces of the odd-numbered sheet of paper S and the even-numbered sheet of paper S are pasted to each other while drawing the papers S downward in FIG. 2. Further, when the papers S are drawn to some extent, the papers S are released from being gripped by the grippers of the pasting rollers 56*a*, 56*b*. The adhesion surfaces of the papers S are pasted to each other while also drawing the papers S downward with the rotation of the pasting rollers 56*a*, 56*b* after the papers S have been released from being gripped. It is to be noted that the papers S of which adhesion surfaces have been pasted to each other are fed to the side of the book-binding apparatus 70.

As illustrated in FIG. 1, the book-binding apparatus 70 includes a book-binding controller 72, a book-binding mechanism 74, and a discharge mechanism 76. The book-binding controller 72 has a CPU, a ROM, and a RAM (not illustrated), and the like, and controls the entire apparatus. The book-binding mechanism 74 has a book cover tray (not illustrated) and combines the papers S which have been discharged from the paste application apparatus 50 with a book cover supplied from the book cover tray to bind into a photo book PB. The discharge mechanism 76 has a discharge roller (not illustrated) and the like and discharges the photo book PB which has been bound by the book-binding mechanism 74 to a discharge tray 76*a*.

The book-binding controller 72 is connected to the computer 80 in a communicable manner, receives a book-binding command from the computer 80, and transmits a book-binding state to the computer 80. If the book-binding controller 72 receives a book-binding command, the book-binding controller 72 controls the book-binding mechanism 74 and the discharge mechanism 76 to bind the papers S fed from the paste application apparatus 50 into a photo book PB and discharge the photo book PB based on the received book-binding command. In the book-binding process, the papers S which have been discharged from the paste application apparatus 50 are combined with the book cover and ends (left ends in FIG. 3) of the papers S are bound to a central portion of an inside face of the book cover with a string, a wire, paste, or the like, for example, so as to bind a book as illustrated in FIG. 3. It is to be noted that since the book-binding mechanism 74 and the discharge mechanism 76 do not constitute a core of the invention, detail description of each mechanism is omitted.

The computer 80 is configured as a general-purpose computer including a computer main body 81, a display 86, and an input device 88 such as a keyboard and a mouse. A CPU 82 which performs various processings, a hard disk drive (HDD) 83 in which various applications, data, and the like are stored, a RAM 84 which temporarily stores data, and the like are incorporated in the computer main body 81. Various pieces of information are displayed on the display 86. A user inputs various commands with the input device 88. The computer 80 receives selection of an image to be printed and setting of a type of paper S on a book-binding setting screen (not illustrated) displayed on the display 86 through an operation on the input device 88 by a user. Further, the computer 80 generates a print command for the print apparatus 30, a paste application command for the paste application apparatus 50, and a book-binding command for the book-binding apparatus 70 based on the received content. Then, the computer 80 outputs the print command to the print apparatus 30, inputs a print state from the print apparatus 30, outputs the paste application command to the paste application apparatus 50 based on the input print state, inputs a paste application state from the paste application apparatus 50, outputs the book-binding command to the book-binding apparatus 70 based on the input paste application state, and inputs a book-binding state from the book-binding apparatus 70.

Figure 4:
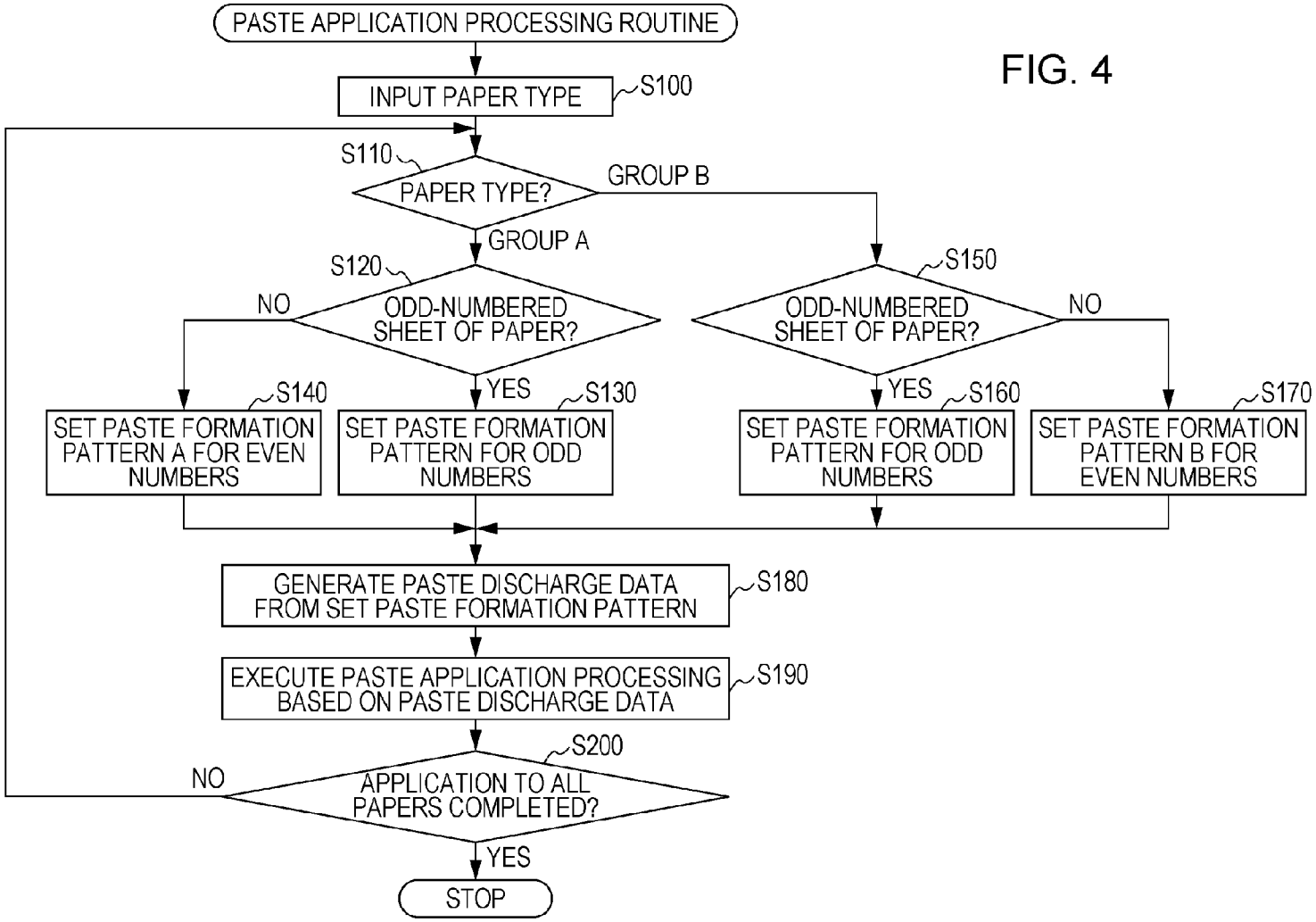
FIG. 4 is a flowchart illustrating an example of a paste application processing routine.

Next, an operation of the book-binding system 10 configured in the above manner in the embodiment, in particular, an operation when paste is applied to the paper S on the paste application apparatus 50 is described. FIG. 4 is a flowchart illustrating an example of a paste application processing routine executed by the paste application controller 52. The routine is executed when the paste application command from the computer 80 is received. If the routine is executed, the paste application controller 52 inputs a paper type of the paper S, which is contained in the received paste application command (step S100), judges whether the input paper type is either of groups A, or B (step S110). The judgment is performed with reference to a paper type classification table (not illustrated) stored in the ROM of the paste application controller 52. When paste is applied to each of the odd-numbered sheet of paper S and the even-numbered sheet of paper S so as to paste the adhesion surfaces thereof to each other, an application amount of the paste used for the adhesion tends to be larger in comparison with a case where the paste is applied to one paper S only and the paper S is pasted to an adhesion target. If the paste application amount is larger, the papers S cannot completely absorb the permeating paste depending on a paste permeation degree into the papers S, paper thickness, and the like resulting in causing wrinkle-form deformation in the paper S in some case. Further, in the book-binding system 10, a plurality of paper types can be used and the paste permeation degree, the paper thickness, and the like are different among the paper types. Therefore, when the adhesion surfaces of the papers S are pasted to each other, deformation thereof (finished state) is different among the paper types. Such differences among the paper types are previously obtained through experiments or the like by preparing a glossy photo paper, a matte photo paper, a matte paper, a plain paper, and the like. Then, paper types which are relatively difficult to be deformed even if the paste application amount is larger are classified into a group A and paper types which are relatively easy to be deformed if the paste application amount is larger are classified into a group B. These classified groups A, B are previously stored in the ROM of the paste application controller 52 as the paper type classification table (not illustrated).

Figure 5:
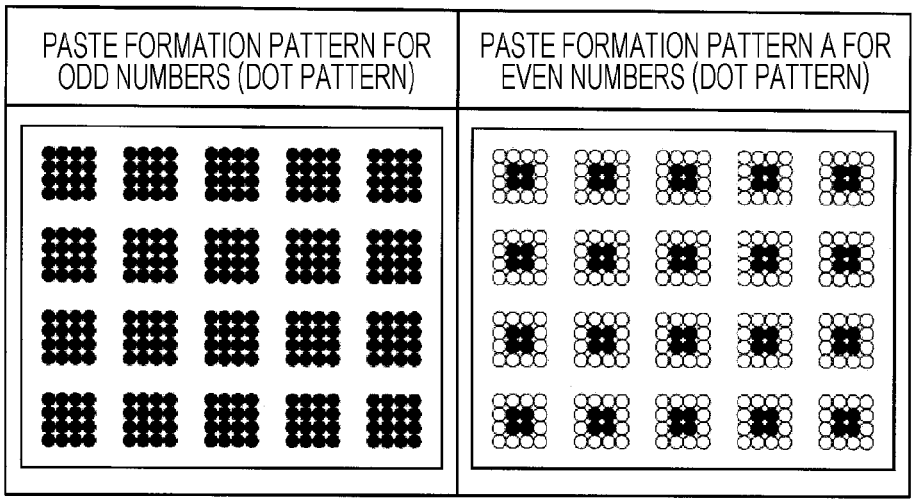
FIG. 5 is a descriptive diagram illustrating an example of a paste formation pattern.

When a paper type belongs to the group A, it is judged whether or not a paper S as an application target is an odd-numbered sheet of paper S such as a first or third sheet of paper (step S120). When the paper S as the application target is the odd-numbered sheet of paper S, a paste formation pattern for odd numbers is set (step S130). When the paper S as the application target is not the odd-numbered sheet of paper S and is an even-numbered sheet of paper S such as a second or fourth sheet of paper, a paste formation pattern A for even numbers is set (step S140). FIG. 5 is a descriptive diagram illustrating an example of a paste formation pattern. A black circle in FIG. 5 indicates one dot formed by discharge of the paste. As illustrated in FIG. 5, the paste formation pattern for odd numbers is defined as a dot pattern on which a plurality of dot groups are arranged in an island form. On the paste formation pattern for odd numbers, each dot group in which respective four dots are arranged in a matrix is formed by 16 dots in total. On the other hand, the paste formation pattern A for even numbers is defined as a dot pattern on which a plurality of dot groups are arranged in an island form. On the paste formation pattern A for even numbers, each dot group in which respective two dots are arranged in a matrix is formed by 4 dots in total. Each dot group on the paste formation pattern A for even numbers is one size smaller than each dot group on the paste formation pattern for odd numbers and is arranged at an opposing position to each dot group on the paste formation pattern for odd numbers. Dots on the paste formation pattern A for even numbers, which are omitted against dots on the paste formation pattern for odd numbers, are indicated by white circles in FIG. 5. That is to say, each dot group on the paste formation pattern A for even numbers is defined as a pattern on which 12 dots in total, which are arranged on an outer-most circumference among dots forming each group on the paste formation pattern for odd numbers, are not formed. It is to be noted that the opposing position indicates a position at which centers of the respective dot groups are identical to each other when the adhesion surface of the odd-numbered sheet of paper S and the adhesion surface of the even-numbered sheet of paper S are pasted to each other. Further, a case where a right side of the odd-numbered sheet of paper S and a left side of the even-numbered sheet of paper S are set to be reference sides (see, FIG. 3) and the odd-numbered sheet of paper S and the even-numbered sheet of paper S are pasted to each other while matching the reference sides to each other is considered. In this case, dot groups formed on the papers S can be positioned to be symmetric with respect to the reference sides when the papers S are pasted to each other.

Figure 6:
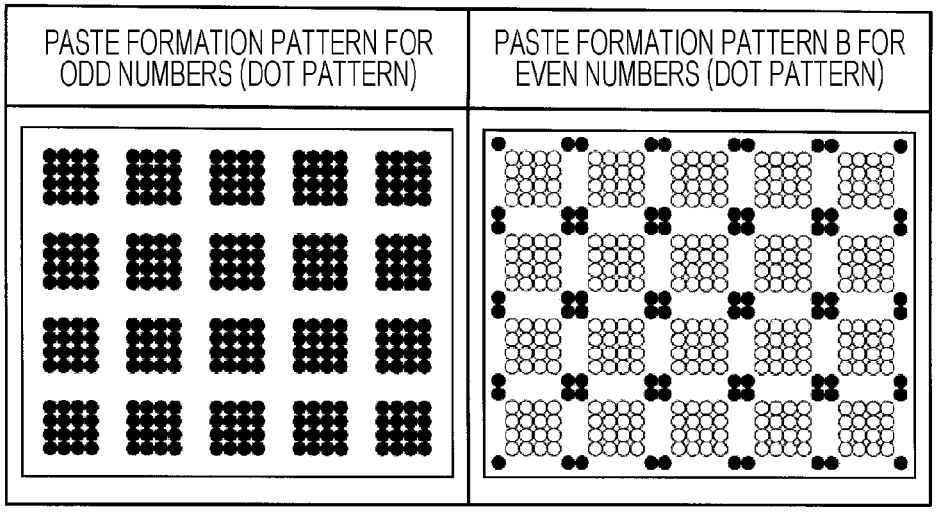
FIG. 6 is a descriptive diagram illustrating an example of a paste formation pattern.

On the other hand, when the paper type belongs to the group B, it is judged whether or not a paper S as an application target is an odd-numbered sheet of paper S (step S150). When the paper S as the application target is an odd-numbered sheet of paper S, a paste formation pattern for odd numbers is set (step S160). When the paper S as the application target is an even-numbered sheet of paper S, a paste formation pattern B for even numbers is set (step S170). FIG. 6 is a descriptive diagram illustrating an example of a paste formation pattern. Black circles in FIG. 6 indicate dots to be formed and white circles in FIG. 6 indicate dots which are not formed likely in FIG. 5. As illustrated in FIG. 6, the paste formation pattern for odd numbers is defined as a pattern which is the same as the paste formation pattern for odd numbers in FIG. 5. On the other hand, the paste formation pattern B for even numbers is defined as a dot pattern on which a plurality of dot groups each of which is formed by four dots in total are arranged in an island form. However, positions of the dot groups on the paste formation pattern B for even numbers are different from those on the paste formation pattern A for even numbers in FIG. 5. On the paste formation pattern B for even numbers, the dot groups are arranged on regions which are deviated from regions on which dot groups on the paste formation pattern for odd numbers are formed. Further, dot groups formed on the paste formation pattern for odd numbers are indicated by white circles on the paste formation pattern B in FIG. 6. The dot groups on the paste formation pattern for odd numbers and the dot groups on the paste formation pattern B for even numbers are arranged in a zigzag form. As described above, the paste formation pattern B for even numbers is defined such that the dot groups are arranged at non-opposing positions on regions which are deviated from the regions on which the dot groups on the paste formation pattern for odd numbers are formed.

If the paste formation pattern is set in the above manner, discharge data of the nozzles as on/off data of discharge through each nozzle of the paste discharge head 65 is generated from the set paste formation pattern (step S180). Next, the paste application processing is executed on the paper S based on the generated paste discharge data (step S190). The paste application processing is performed by repeating the following processings. That is, processings of controlling the carriage motor 63*a* such that the carriage 61 reciprocates in the main scanning direction, driving piezoelectric elements of the paste discharge head 65 such that paste is discharged onto the paper S based on the paste application data, and controlling the drive motor 66*a* such that the paper S is transported in the sub scanning direction by a predetermined amount for each pass are repeated. If the paste application processing is executed in this manner, it is judged whether or not the processing on all the papers S has been completed (step S290). If the processing has not been completed, the process returns to step S100 and the processings are repeated. If the processing has been completed, the routine is ended.

With this, the paste is applied to the odd-numbered sheet of paper S based on the paste formation pattern for odd numbers and the paste is applied to the even-numbered sheet of paper S based on either of the paste formation patterns A, B for even numbers depending on paper types. Therefore, when the papers S of which paper type belongs to the group A are used, positions of paste application regions formed on the adhesion surface of the odd-numbered sheet of paper S are opposed to positions of paste application regions formed on the adhesion surface of the even-numbered sheet of paper S. Therefore, in this case, when the adhesion surfaces are pasted to each other, the application regions can be overlapped with one another so as to paste the adhesion surfaces to each other more firmly. Further, each dot group on the paste formation pattern A for even numbers is one size smaller than each dot group on the paste formation pattern for odd numbers. Therefore, the paste application amount can be suppressed while overlapping the application regions with one another. It is to be noted that as described above, the paper S of which paper type belongs to the group A is relatively difficult to be deformed. Therefore, even if the paste application amount becomes partially larger by overlapping the paste application regions with one another, a risk that the papers S are deformed is small. On the other hand, when the papers S of which paper type belongs to the group B are used, the positions of the paste application regions formed on the adhesion surface of the odd-numbered sheet of paper S are not opposed to the positions of the paste application regions formed on the adhesion surface of the even-numbered sheet of paper S. Therefore, when the adhesion surfaces are pasted to each other, the paste application regions can be made so as not to be overlapped with one another. As described above, the paper S of which paper type belongs to the group B is relatively easy to be deformed. Therefore, the paste application regions are made so as not to be overlapped with one another so that wrinkle-form deformation can be prevented. In the embodiment, the paste is applied to the adhesion surfaces as island-form dot groups. Therefore, an amount of the paste to be applied can be suppressed in comparison with a case where the paste is uniformly applied to the entire of the adhesion surfaces. With these configurations, when the adhesion surfaces of the papers S are pasted to each other, the paste application amount can be suppressed while ensuring an appropriate adhesive force.

Figure 7A:
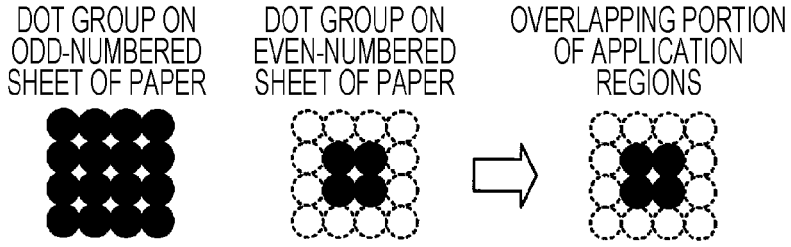
FIGS. 7A and 7B are descriptive diagrams illustrating a relationship between presence/absence of deviation and an overlapping portion of application regions.
Figure 7B:
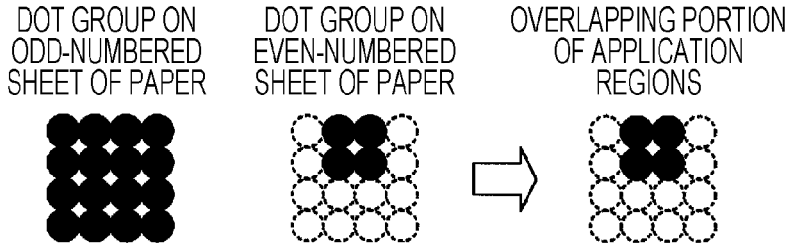

Then, a reason why dots on the outer-most circumference on each dot group are not formed on the paste formation pattern A for even numbers such that each dot group on the paste formation pattern A for even numbers as illustrated in FIG. 5 is one size smaller than each dot group on the paste formation pattern for odd numbers is further described. Note that when the paste is discharged from the paste discharge head 65 in dot-pattern form, landing positions (formation positions) of the paste dots are slightly deviated in some case. Further, when the adhesion surfaces are pasted to each other, they are pasted to each other in a slightly deviated manner in some case. If such deviation is generated, positions of the dot groups formed on the odd-numbered sheet of paper S and positions of the dot groups formed on the even-numbered sheet of paper S are deviated from each other. FIGS. 7A and 7B are descriptive diagrams illustrating a relationship between presence/absence of deviation and an overlapping portion of application regions. When the deviation is not generated, the overlapping portion of the application regions has a size for four dots as illustrated in FIG. 7A. On the other hand, when the positional deviation for one dot is generated on the dot group on the paste formation pattern for even numbers as illustrated in FIG. 7B, for example, the overlapping portion of the application regions is deviated for one dot but has the size which is the same as that in the case where the deviation is not generated. With this, even if the deviation is generated, the adhesive force can be made to be equivalent to that in the case where the deviation is not generated. The dots on the outer-most circumference on each dot group are not formed on the paste formation pattern A for even numbers such that each dot group on the paste formation pattern A for even numbers is one size smaller than each dot group on the paste formation pattern for odd numbers for the above reason.

Here, a correspondence relationship between constituent components in the embodiment and constituent components in the invention is clarified. The paste application controller 52 of the paste application apparatus 50 which executes the processings at steps S110 to S170 in the paste application processing routine in FIG. 4 in the embodiment corresponds to a "dot pattern setting unit" according to the invention. The application controller 52 which executes the processings at steps S180 and S190 in the paste application processing routine in FIG. 4 corresponds to a "control unit". It is to be noted that in the embodiment, an example of a control method of the paste application apparatus according to the invention is clarified by describing the operation of the paste application controller 52.

According to the paste application apparatus 50 in the embodiment which has been described above, the paste formation pattern for odd numbers on which dot groups are arranged in an island form and the paste formation pattern A for even numbers on which dot groups are arranged at opposing positions to the dot groups on the paste formation pattern for odd numbers in an island form are set. Further, the paste discharge head 65 is controlled such that the set paste formation pattern for odd numbers is formed on the adhesion surface of the odd-numbered sheet of paper S and the paste discharge head 65 is controlled such that the set paste formation pattern A for even numbers is formed on the adhesion surface of the even-numbered sheet of paper S. With this, the paste application amount can be suppressed in comparison with a case where the paste is uniformly applied to the entire surfaces of both the adhesion surfaces. In addition, the application regions of both the adhesion surfaces can be overlapped with one another. Therefore, the paste application amount can be suppressed while ensuring an appropriate adhesive force.

Further, on the paste formation pattern A for even numbers, dots on the outer-most circumference on each dot group are not formed on the paste formation pattern A for even numbers such that each dot group on the paste formation pattern A for even numbers is one size smaller than each dot group on the paste formation pattern for odd numbers. Therefore, the paste application amount can be suppressed while overlapping the application regions with one another. Further, even if the deviation is generated, the adhesive force can be made to be equivalent to that in the case where the deviation is not generated. In addition, processings are switched depending on groups to which the paper type of the paper S belongs. Therefore, the paste application regions can be made so as to be overlapped with one another when the papers S of which paper type belongs to the group A are used and the paste application regions can be made so as not to be overlapped with one another when the papers S of which paper type belongs to the group B which is different from the group A are used.

It is needless to say that the invention is not limited to the embodiment described above and can be implemented in various aspects as long as they are within the technical scope of the invention.

Figure 8:
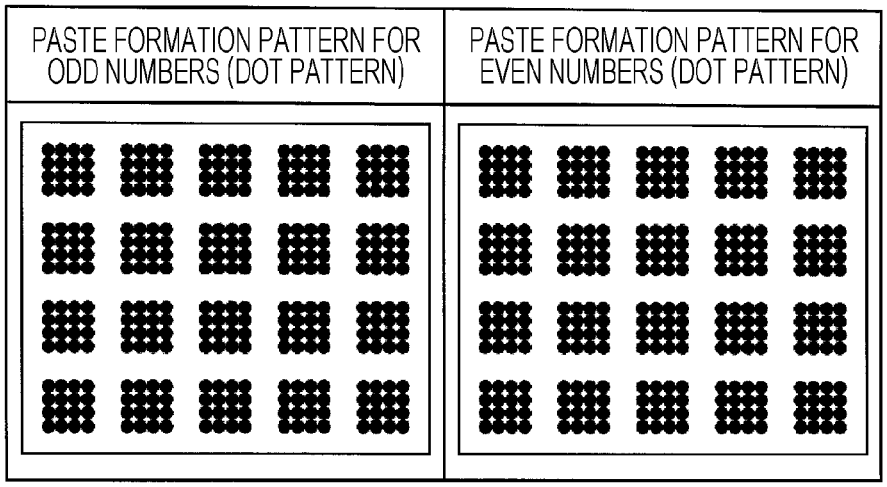
FIG. 8 is a descriptive diagram illustrating an example of a variation on a paste formation pattern.

In the above embodiment, each dot group on the paste formation pattern A for even numbers is defined to be one size smaller than each dot group on the paste formation pattern for odd numbers. However, the invention is not limited thereto and it is advisable that each dot group on the paste formation pattern A for even numbers is defined to have the same size as each dot group on the paste formation pattern for odd numbers. A paste formation pattern according to a variation in this case is illustrated in FIG. 8. Further, the invention is not limited to the paste formation pattern A for even numbers on which dots on the outer-most circumference on each dot group are not formed such that each dot group on the paste formation pattern A for even numbers is one size smaller than each dot group on the paste formation pattern for odd numbers. Alternatively, it is advisable that dots for several dots at the outer circumference side are not formed on the paste formation pattern A for even numbers. In this case, an amount of deviation to be generated is previously obtained through experiments or the like and the number of dots corresponding to the amount of deviation is calculated from a relationship between the obtained amount of deviation and a dot density. It is sufficient that the dots for the calculated number of dots at the outer circumference side are not formed. For example, if the amount of deviation to be generated corresponds to an amount for two dots, it is sufficient that dots by two rounds at the outer circumference side are not formed.

In the above embodiment, each dot group on the paste formation pattern for odd numbers is made to have the same size and each dot group on the paste formation patterns for even numbers is also made to have the same size. However, the invention is not limited thereto. It may be advisable that dot groups on either of the paste formation patterns are made to have two sizes including a large size and a small size. Alternatively, it is advisable that dot groups on both of the paste formation patterns are made to have two sizes including a large size and a small size or have equal to or more than two sizes.

In the above embodiment, paste application regions are overlapped with one another only when the papers S of which paper type belongs to the group A are used. However, the invention is not limited thereto. It may be advisable that the paper type is not to be limited and paste application regions are overlapped with one another when papers S of any types are used. In this case, it is sufficient that the processings at steps S100, S110, S150 to S170 in the paste application processing routine in FIG. 4 are omitted. It is to be noted that in the paste application apparatus 50 which applies paste to only papers S for which no wrinkle-form deformation problem arises no problem, the paper type is not limited.

In the above embodiment, the sizes of dots formed by discharging the paste are made to be constant. However, the invention is not limited thereto and it is advisable that the sizes of dots themselves may be changed as adjustment of a discharge amount of ink in the ink jet printer.

Figure 9:
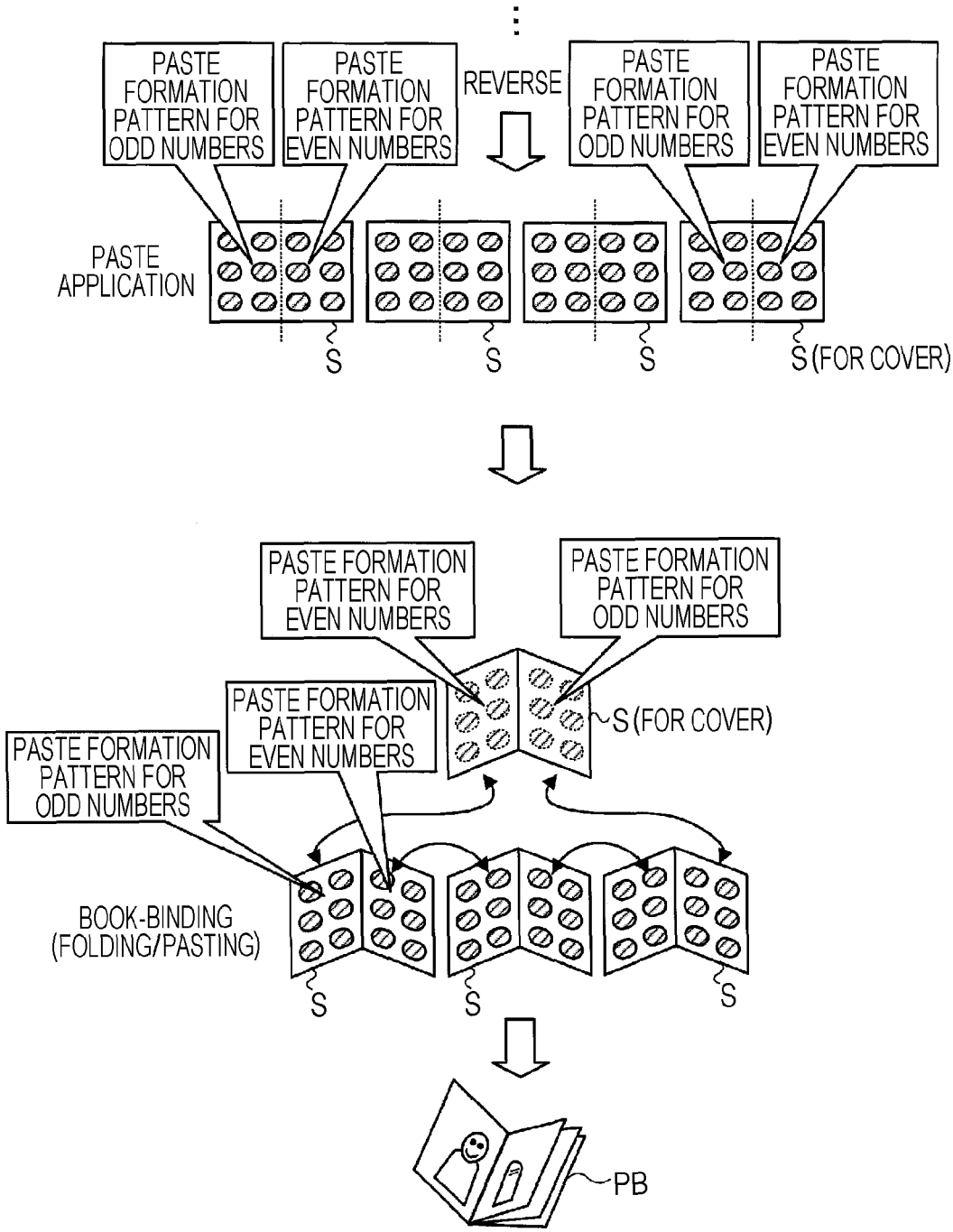
FIG. 9 is a descriptive diagram illustrating a part of a process in a book-binding system according to the variation.

In the above embodiment, the adhesion surface of the odd-numbered sheet of paper S and the adhesion surface of the even-numbered sheet of paper S are pasted to each other. However, the invention is not limited thereto. For example, it is advisable that an odd-numbered sheet of paper S is mountain-folded in half so as to paste the adhesion surfaces of the mountain-folded paper S to each other and an even-numbered sheet of paper S is mountain-folded in half so as to paste the adhesion surfaces of the mountain-folded paper S to each other. Alternatively, it is advisable that an odd-numbered sheet of paper S and an even-numbered sheet of paper S are both valley-folded in half, thereafter an adhesion surface (half-surface) of the odd-numbered sheet of paper S and an adhesion surface (half-surface) of the even-numbered sheet of paper S are sequentially pasted to each other. A part of a process according to a variation in the latter case is indicated in FIG. 9. FIG. 9 illustrates a process after the reversal in each process in the book-binding system 10 as illustrated in FIG. 3. It is sufficient that the book-binding system 10 includes a folding mechanism (not illustrated) for folding the paper S in order to perform the process. In this case, as illustrated in FIG. 9, it is sufficient that the paste formation pattern for odd numbers is set to a side (left half in FIG. 9) of the adhesion surface which is to be an odd-numbered page and the paste formation pattern for even numbers is set to a side (right half in FIG. 9) of the adhesion surface which is to be an even-numbered page for both of the odd-numbered sheet of paper S and the even-numbered sheet of paper S so as to apply the paste thereto. In the former case, it is sufficient that the paste formation patterns are also set in the same manner.

In the above embodiment, the paste application apparatus 50 includes the reversal mechanism 54 and the pasting mechanism 56 in addition to the paste application mechanism 60. However, the invention is not limited thereto and it may be advisable that the paste application apparatus 50 does not have either of the reversal mechanism 54 or the pasting mechanism 56. Alternatively, it is advisable that the paste application apparatus 50 does not have both of the reversal mechanism 54 and the pasting mechanism 56. Further, in the above embodiment, the paste application apparatus 50 is incorporated in the book-binding system 10 so as to apply the paste to the papers S to be bound. However, the invention is not limited thereto and it is advisable that the paste application apparatus 50 applies paste to media independently.

In the above embodiment, the liquid-form paste is used. However, the invention is not limited thereto and it is sufficient that an adhesive which can be discharged from a discharge head is used and such as a gel-form adhesive may be used. In addition, the paper S is used as a medium in the above embodiment. However, the invention is not limited thereto and an adhesive may be applied to media made of any materials as long as the media which can be adhered to each other, such as metal, plastic, rubber, and ceramics are used.

What is claimed is:

1. An adhesive application apparatus which discharges an adhesive from a discharge head onto adhesion surfaces of media, which are pasted to each other, so as to apply the adhesive in dot-pattern form, comprising:

a dot pattern setting unit that sets a first dot pattern on which dot groups each of which is formed by a plurality of dots are arranged in an island form and a second dot pattern on which dot groups each of which is formed by a plurality of dots are arranged at opposing positions to the dot groups on the first dot pattern in an island form; and a control unit configured to control the discharge head such that the set first dot pattern is formed on one adhesion surface of the adhesion surfaces and controls the discharge head such that the set second dot pattern is formed on the other adhesion surface of the adhesion surfaces, wherein the dot pattern setting unit forms each dot group on the second dot pattern so as to be one size smaller than each dot group on the first dot pattern, wherein the dot pattern setting unit arranges each dot group in which dots positioned at an outer-most circumference among dots forming each dot group on the first dot pattern are not formed as each dot group on the second dot pattern.

2. An adhesive application apparatus which discharges an adhesive from a discharge head onto adhesion surfaces of media, which are pasted to each other, so as to apply the adhesive in dot-pattern form, comprising:

a dot pattern setting unit that sets a first dot pattern on which dot groups each of which is formed by a plurality of dots are arranged in an island form and a second dot pattern on which dot groups each of which is formed by a plurality of dots are arranged at opposing positions to the dot groups on the first dot pattern in an island form; and a control unit configured to control the discharge head such that the set first dot pattern is formed on one adhesion surface of the adhesion surfaces and controls the discharge head such that the set second dot pattern is formed on the other adhesion surface of the adhesion surfaces, wherein the dot pattern setting unit sets the second dot pattern such that each dot group on the second dot pattern is arranged at an opposing position to each dot group on the first dot pattern under a condition that a predetermined type of media are used as the media, wherein the dot pattern setting unit sets the second dot pattern such that each dot group on the second dot pattern is arranged at a non-opposing position deviated from the opposing position to each dot group on the first dot pattern when media of which type is different from the predetermined type are used as the media.

3. A control method of an adhesive application apparatus which discharges an adhesive from a discharge head onto adhesion surfaces of media, which are pasted to each other, so as to apply the adhesive in dot-pattern form, comprising:

setting a first dot pattern on which dot groups each of which is formed by a plurality of dots are arranged in an island form and a second dot pattern on which dot groups each of which is formed by a plurality of dots are arranged at opposing positions to the dot groups on the first dot pattern in an island form; and controlling the discharge head such that the set first dot pattern is formed on one adhesion surface of the adhesion surfaces and controlling the discharge head such that the set second dot pattern is formed on the other adhesion surface of the adhesion surfaces;

forming each dot group on the second dot pattern to be one size smaller than each dot group on the first dot pattern, arranging each dot group in which dots positioned at an outer-most circumference among dots forming each dot group on the first dot pattern are not formed as each dot group on the second dot pattern.

* * * * *